US007207773B2

(12) United States Patent
O'Clair et al.

(10) Patent No.: US 7,207,773 B2
(45) Date of Patent: Apr. 24, 2007

(54) STEAM TURBINE NOZZLE BOX

(75) Inventors: Charles Thomas O'Clair, Waterford, NY (US); Michael Thomas Hamlin, Schoharie, NY (US)

(73) Assignee: General Electric Company, Schenectady, NY (US)

( * ) Notice: Subject to any disclaimer, the term of this patent is extended or adjusted under 35 U.S.C. 154(b) by 243 days.

(21) Appl. No.: 11/058,648

(22) Filed: Feb. 16, 2005

(65) Prior Publication Data

US 2006/0182625 A1 Aug. 17, 2006

(51) Int. Cl.
*F01D 9/02* (2006.01)

(52) U.S. Cl. ..... 415/191; 415/194; 415/209.1

(58) Field of Classification Search ..... 415/185, 415/191, 194, 209.1
See application file for complete search history.

(56) References Cited

U.S. PATENT DOCUMENTS

| | | | | |
|---|---|---|---|---|
| 2,869,821 | A | 1/1959 | Halford et al. | |
| 5,259,727 | A * | 11/1993 | Quinn | 415/190 |
| 5,392,513 | A * | 2/1995 | Mazzola et al. | 29/889.1 |
| 6,196,793 | B1 * | 3/2001 | Braaten | 415/191 |
| 6,631,858 | B1 | 10/2003 | Farineau et al. | |

FOREIGN PATENT DOCUMENTS

| | | |
|---|---|---|
| FR | 1332035 | 12/1963 |
| JP | 11-343805 | 12/1999 |

OTHER PUBLICATIONS

Abstract of JP 11-343805, *Patent Abstracts of Japan*, vol. 2000, No. 3, Mar. 30, 2000.

* cited by examiner

*Primary Examiner*—Ninh H. Nguyen
(74) *Attorney, Agent, or Firm*—Nixon & Vanderhye, P.C.

(57) ABSTRACT

A nozzle box includes a torus, bridge ring and nozzle ring portions wherein steam flowing generally circumferentially in the torus portion is redirected for flow generally axially by the bridge ring portion. The steam exiting the bridge ring portion flows into nozzles formed by adjacent partitions of the nozzle ring portion. Bridges in the bridge ring portion are tangentially leaned to exactly match the angle of inclination of the leading edges of the axially adjacent partitions at like circumferential locations. For strength purposes, there are two bridges for each partition. Every other bridge axially registers with the leading edge of the axially downstream partition matching its angle while remaining bridges are equally spaced between the aligned bridges. In this manner, the steam flow is straightened by the bridges to match the angle of the leading edge of the nozzle partitions with consequent reduction of passage area loss.

15 Claims, 4 Drawing Sheets

STEAM TURBINE NOZZLE BOX

BACKGROUND OF THE INVENTION

The present invention relates to a nozzle box for a steam turbine for directing steam flow from a generally circumferential direction to a generally axial direction for flow through nozzles and particularly relates to a nozzle box having bridges tangentially leaned to match the angles of the leading edges of the partitions.

In steam turbines, nozzle boxes are provided for receiving a flow of steam and directing the steam through first stage nozzles. A nozzle box typically comprises a torus portion having one or more, generally four, inlets for receiving steam, a bridging portion for facilitating a change in the steam flow from circumferential to generally axial directions, and finally, a nozzle ring portion containing partitions defining nozzles for directing the steam flow onto the buckets of the rotor. Nozzle boxes are typically formed in nozzle box halves arranged in a 180° arc, the nozzle box halves having mating horizontal joints to form a continuous 360° nozzle. Conventional nozzle boxes, for example those disclosed in U.S. Pat. Nos. 6,631,858; 6,196,793; and 5,392,513 are representative examples of the foregoing arrangement. For example, as illustrated in U.S. Pat. No. 6,631,858, the bridge ring portion includes a plurality of bridges axially upstream from the nozzle partitions. It will be appreciated that because of structural concerns requiring a substantial number of bridges, the conventional bridge ring portion with multiple bridges has a tendency to restrict the steam entering the nozzles. The bridges, of course, are used to strengthen the nozzle box as well as to straighten the flow. However, conventional bridges afford substantial passage area loss and are generally not matched with the partitions. Accordingly, there is a need for a nozzle box which can efficiently straighten the steam path and reduce the passage area loss.

DESCRIPTION OF THE INVENTION

In a preferred embodiment of the present invention, there is provided a nozzle box for a steam turbine comprising: a nozzle ring portion about an axis and including a plurality of circumferentially spaced partitions, each partition having a leading edge forming an included angle relative to a radius from the axis passing through the leading edge; and a bridge ring portion about the axis for transitioning steam into the nozzle ring portion; the bridge ring portion including a plurality of circumferentially spaced bridges, each of selected bridges of the plurality thereof extending at an included angle relative to a radius about the axis corresponding to the angle of the leading edge at a like circumferential location about the axis.

In a further preferred object of the present invention, there is provided a nozzle box for a steam turbine comprising: a nozzle ring portion about an axis including a plurality of circumferentially spaced partitions, each partition having a leading edge extending along a tangent from an imaginary cylinder centered about the axis, the imaginary cylinder having a diameter less than the diameter of the nozzle ring portion; and a bridge ring portion about the axis for transitioning steam into the nozzle ring portion, the bridge ring portion including a plurality of circumferentially spaced bridges extending along tangents from the imaginary cylinder.

In a still further preferred aspect of the invention, there is provided a nozzle box for a steam turbine comprising: a nozzle ring segment about an axis including a plurality of circumferentially spaced partitions extending between radial inner and outer rings, each partition having a leading edge inclined relative to a radius about the axis through the leading edge; a bridge ring segment about the axis for transitioning steam into the nozzle ring segment and including a plurality of circumferentially spaced bridges, selected bridges thereof being inclined relative to radii about the axis corresponding to the inclinations of the leading edges about the axis at like circumferential locations about the axis.

DETAILED DESCRIPTION OF THE INVENTION

Figure 1:
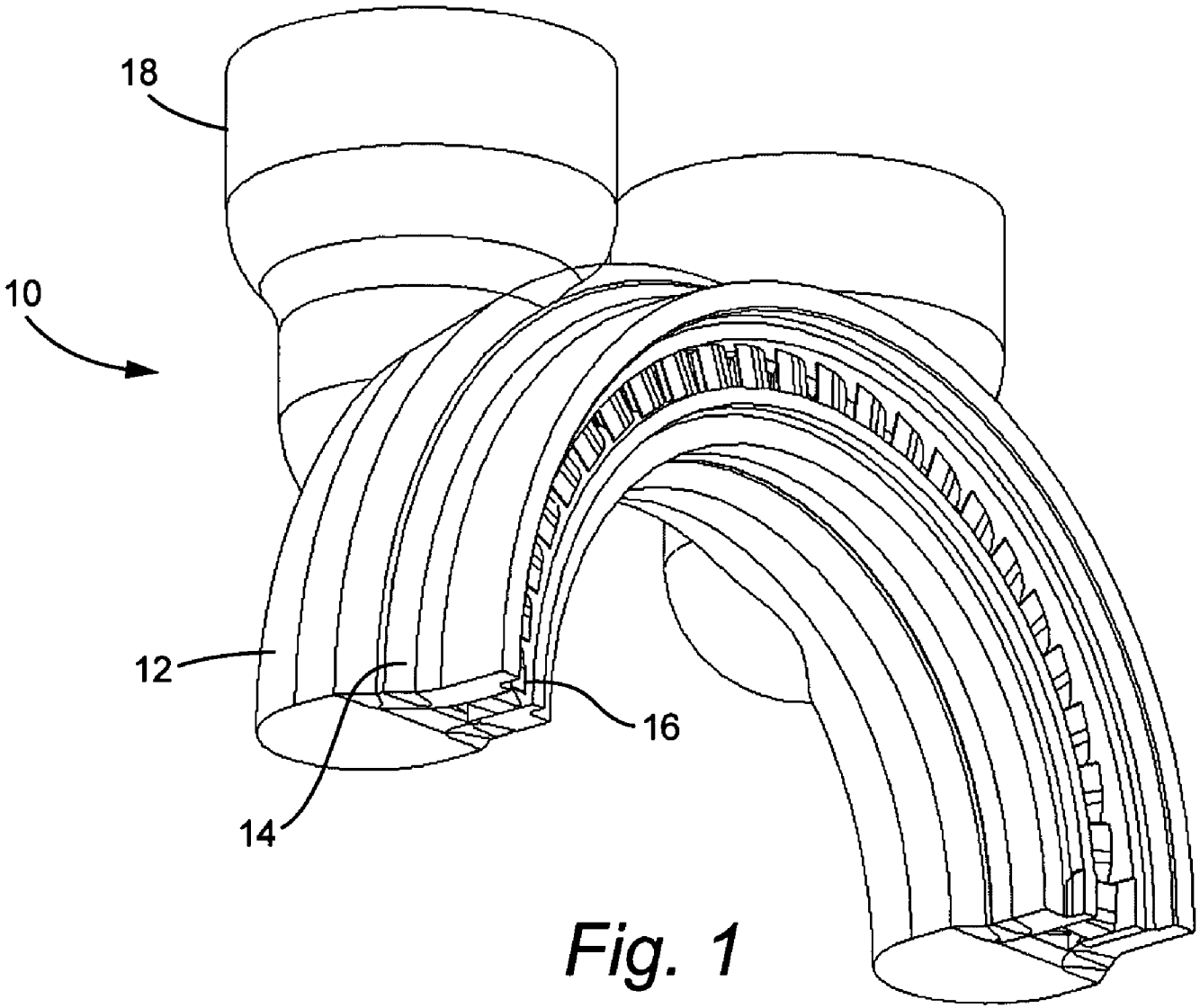
FIG. 1 is a perspective view of one half of a nozzle box.

One-half of a nozzle box generally designated 10 is illustrated in FIG. 1. It will be appreciated that a second half, not shown, of the nozzle box is joined at a horizontal midline to the illustrated nozzle box half whereby a complete nozzle box symmetrical about an axis of rotation of a steam turbine rotor is provided. As illustrated, nozzle box 10 includes a torus portion 12, a bridge ring portion 14 and a nozzle ring portion 16. The nozzle box 10 is typically formed of these three portions secured e.g. welded, to one another although it will be appreciated that the nozzle box may be formed in halves with each half being integrally formed i.e. one piece. Thus, the torus, bridge ring and nozzle ring portions are formed in 180° segments.

Figure 2:
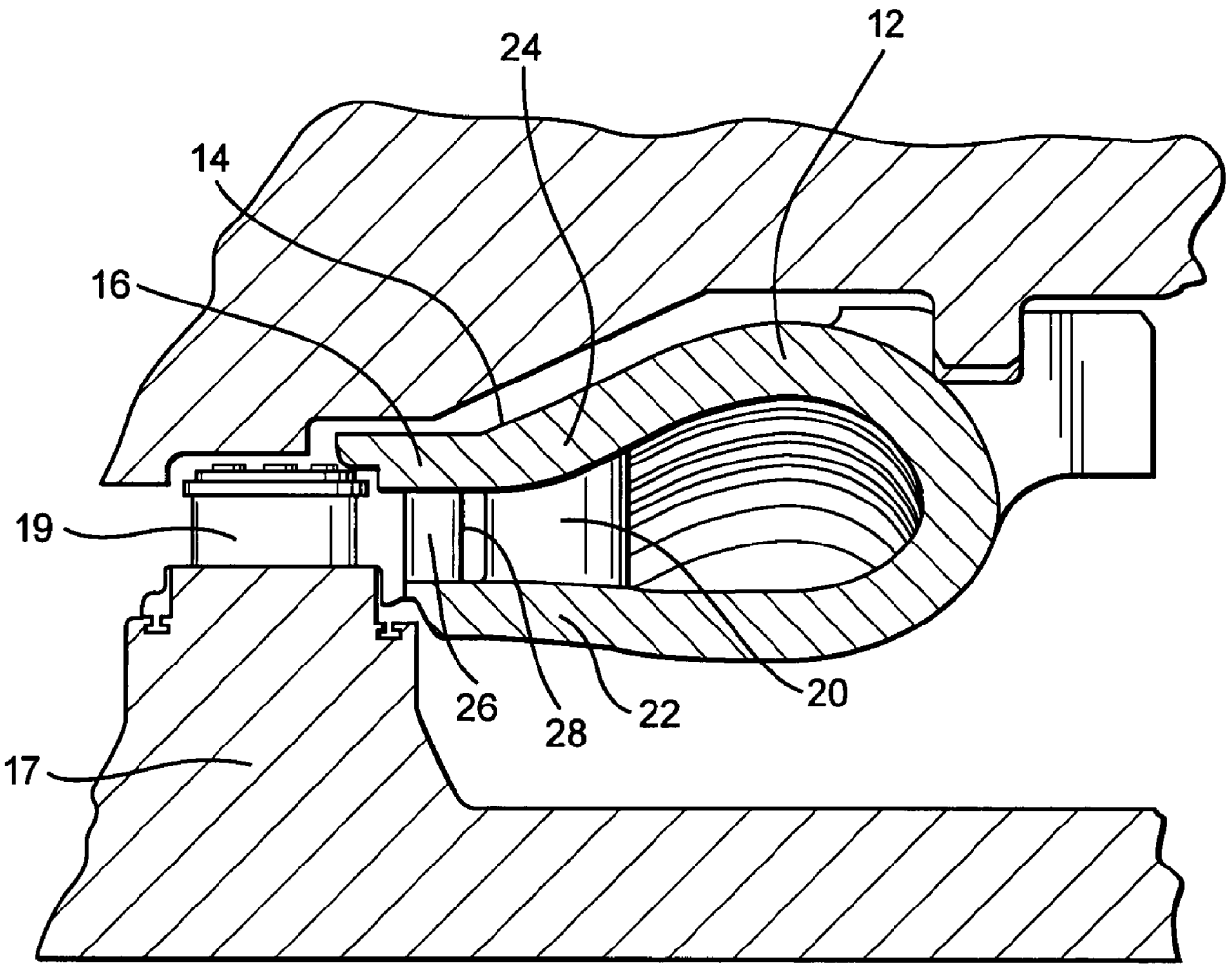
FIG. 2 is a fragmentary cross sectional view through the nozzle box illustrating the torus, bridge ring and nozzle ring portions thereof.

Torus portion 12 lies in communication with one or more steam inlets 18 whereby steam flows from the inlets into the torus portion and in a generally circumferential steam flow direction. Bridge ring portion 14 includes a plurality of circumferentially spaced bridges 20 which extend between inner and outer walls 22 and 24, respectively, (FIG. 2) of the bridge ring portion for facilitating redirection of the generally circumferential steam flow in the torus to a generally axial flow direction into the nozzle ring portion 16. As illustrated in FIG. 2, the nozzle ring portion 16 includes a plurality of partitions 26 circumferentially spaced one from the other and lying directly upstream from buckets 19 of a steam turbine rotor 17.

In accordance with a preferred aspect of the present invention, the bridges 20 of the bridge ring portion 14 are configured and arranged relative to the partitions 26 and particularly the leading edges 28 of the partitions to efficiently straighten the steam flow direction for entry into nozzles formed by the partitions. This reduces the loss of steam passage area typical of prior nozzle box designs.

Figure 3:
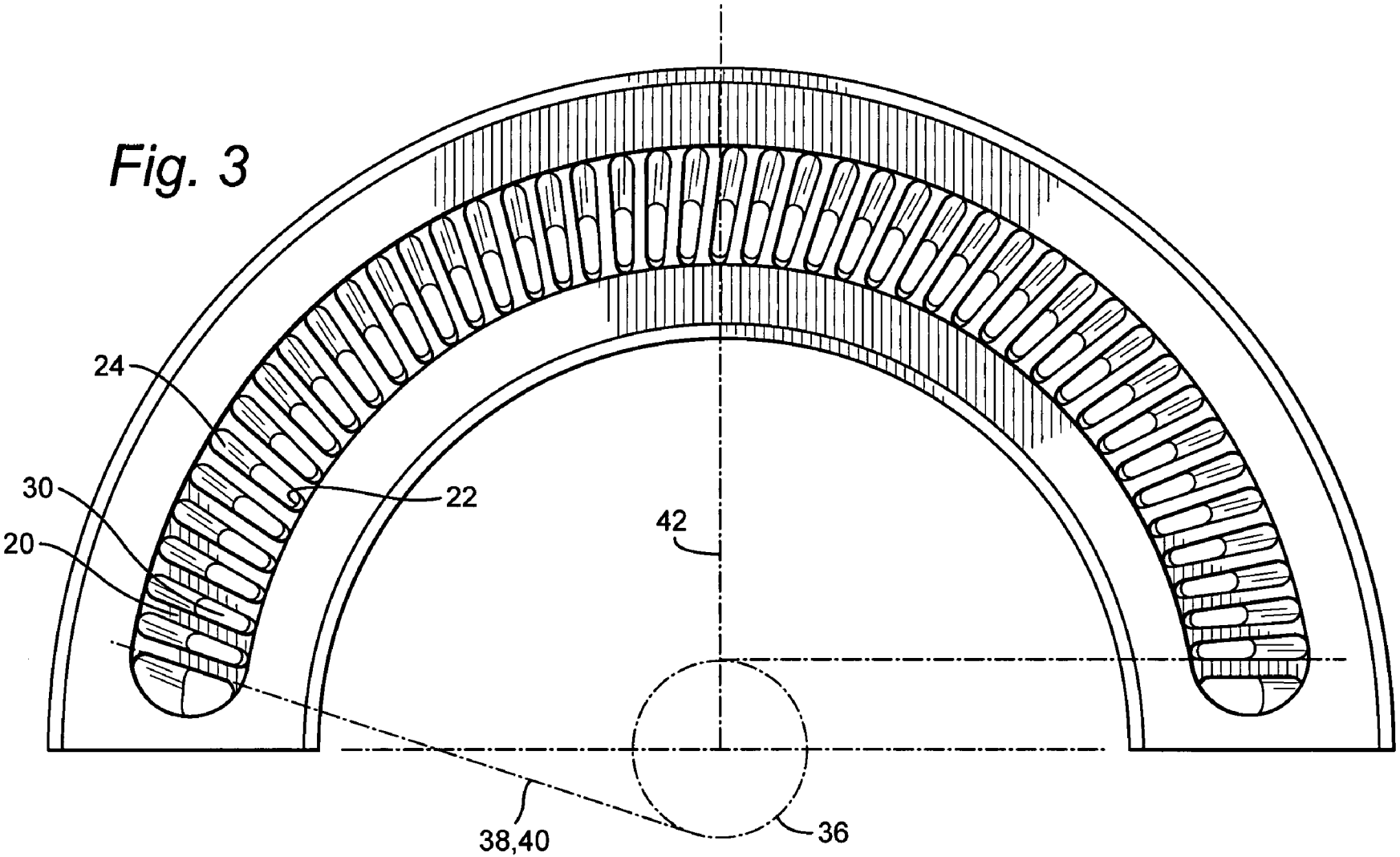
FIG. 3 is an axial view of the bridge ring portion looking in a downstream direction.

Particularly, and referring to FIG. 3, bridges 20 and the passages 30 defined between circumferentially adjacent bridges 20 are illustrated. The leading edges 28 (FIG. 2) of the partitions 26 (FIG. 2) are angled relative to radii 42 from the axis of the nozzle box portion. Each of selected bridges 20 also extends at an angle relative to a radius about the axis of the nozzle box corresponding to the angle of the leading edge 28 (FIG. 2) of the partition 26 (FIG. 2) at like circumferential locations about such axis.

Figure 4:
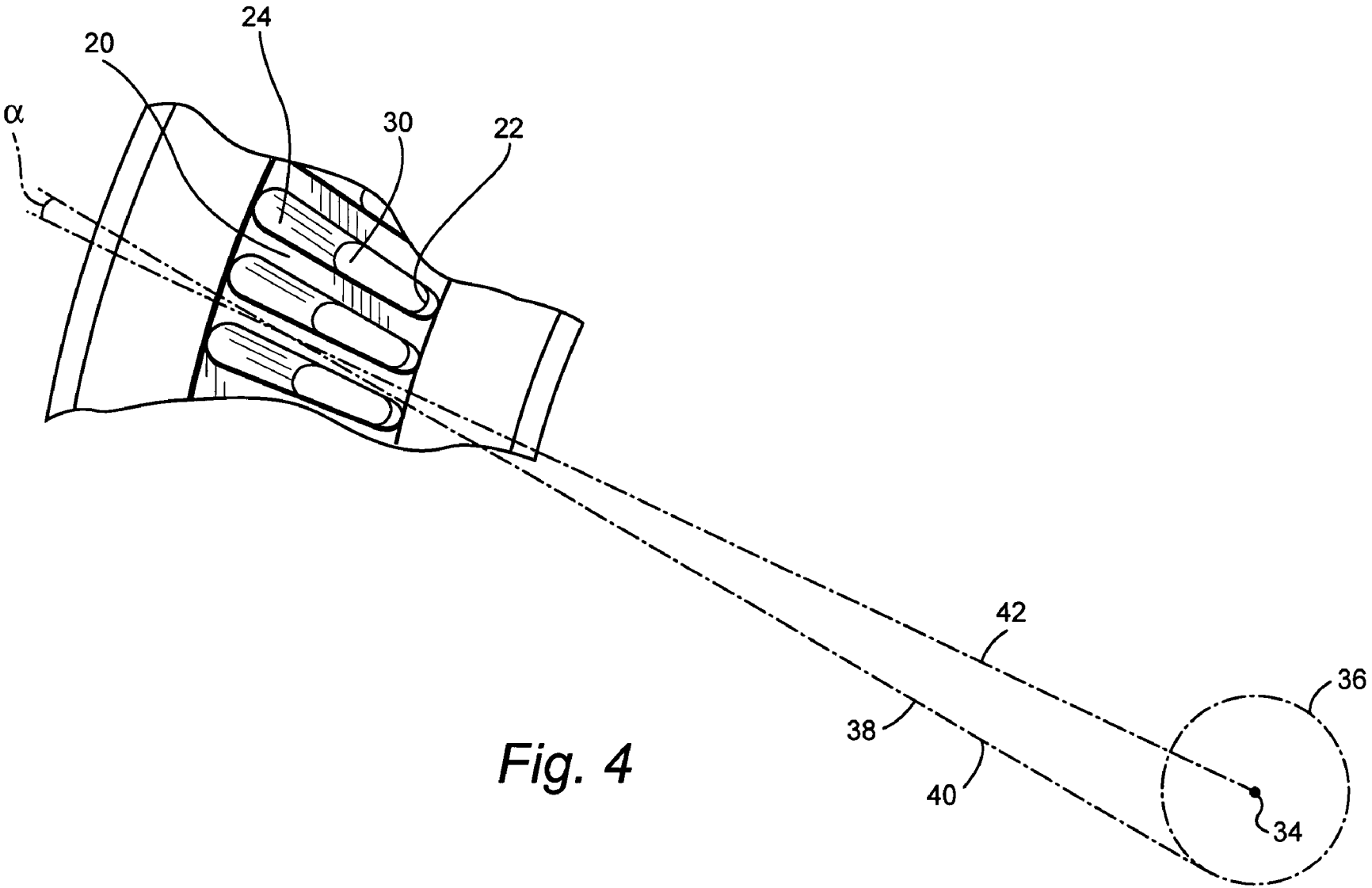
FIG. 4 is an exploded fragmentary illustration of a portion of the bridge ring portion of FIG. 3 illustrating the tangential lean of the bridges.

More particularly, and referring to FIGS. 3 and 4, the leading edge 28 (FIG. 2) of each partition 26 (FIG. 2) axially downstream of a selected or certain bridge extends along a tangent 38 (FIG. 4) from an imaginary cylinder 36 about the axis 34 of the turbine. The imaginary cylinder 36 has a diameter less than the diameter of the nozzle ring portion. Also, each selected bridge 20 lies along a tangent 40 extending from the imaginary cylinder 36 and through the bridge 20. As illustrated in FIG. 4, the tangents 38 and 40 form included angles $\alpha$ with a radius 42 extending through each axially aligned leading edge and bridge 20. That is, selected bridges 20 are leaned in a tangential direction to match the lean or entrance angles of the leading edges 28 (FIG. 2) of the corresponding immediate axially downstream partitions 26 (FIG. 2). The number of bridges 20 is in excess of the number of partitions 26 and preferably, there are twice as many bridges 20 as partitions 26. Thus, every other bridge 20 i.e. each selected bridge 20, is aligned in an axial direction with the leading edge 28 (FIG. 2) of an axially adjacent partition 26 (FIG. 2). The bridges 20 between the aligned selected bridges 20 are equally spaced from the adjacent partitions. With the foregoing arrangement of the bridges vis-à-vis the leading edges of the partitions, a steam flow path is aligned and straightened to enter the nozzles formed by adjacent partitions with consequent reduction of area loss as compared with prior wedge/partition arrangements.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A nozzle box for a steam turbine comprising:

a nozzle ring portion about an axis and including a plurality of circumferentially spaced partitions, each partition having a leading edge forming an included angle relative to a radius from said axis passing through the leading edge; and a bridge ring portion about said axis for transitioning steam into the nozzle ring portion;

said bridge ring portion including a plurality of circumferentially spaced bridges, each of selected bridges of said plurality thereof extending at an included angle relative to a radius about said axis corresponding to the angle of said leading edge at a like circumferential location about the axis.

2. A nozzle box according to claim 1 wherein said selected bridges are located in respective axial registration with the leading edges of said partitions.

3. A nozzle box according to claim 1 wherein the number of bridges is greater than the number of partitions.

4. A nozzle box according to claim 1 wherein said selected bridges are located in respective axial registration with the leading edges of said partitions, remaining bridges of said plurality thereof being equally spaced between said selected partitions.

5. A nozzle box according to claim 1 including a torus portion for receiving steam from an inlet, said bridge ring portion being located relative to said torus portion and said nozzle ring portion for changing steam flow from a generally circumferential direction about said torus portion to a generally axial flow direction for introduction into nozzles formed by said partitions.

6. A nozzle box for a steam turbine comprising:

a nozzle ring portion about an axis including a plurality of circumferentially spaced partitions, each partition having a leading edge extending along a tangent from an imaginary cylinder centered about said axis, the imaginary cylinder having a diameter less than the diameter of the nozzle ring portion; and a bridge ring portion about said axis for transitioning steam into the nozzle ring portion, said bridge ring portion including a plurality of circumferentially spaced bridges extending along tangents from said imaginary cylinder.

7. A nozzle box according to claim 6 wherein selected bridges of said plurality thereof are located in respective axial registration with the leading edges of said partitions.

8. A nozzle box according to claim 6 wherein the number of bridges is greater than the number of partitions.

9. A nozzle box according to claim 6 wherein said selected bridges are located in respective axial registration with the leading edges of said partitions, remaining bridges of said plurality thereof being equally spaced between said partitions.

10. A nozzle box according to claim 6 including a torus portion for receiving steam from an inlet, said bridge ring portion being located relative to said torus portion and said nozzle ring portion for changing steam flow from a generally circumferential direction about said torus portion to a generally axial flow direction for introduction into nozzles formed by said partitions.

11. A nozzle box for a steam turbine comprising:

a nozzle ring segment about an axis including a plurality of circumferentially spaced partitions, each partition having a leading edge inclined relative to a radius about the axis through said leading edge;

a bridge ring segment about said axis for transitioning steam into the nozzle ring segment and including a plurality of circumferentially spaced bridges, selected bridges thereof being inclined relative to radii about the axis corresponding to the inclinations of said leading edges about said axis at like circumferential locations about said axis.

12. A nozzle box according to claim 11 wherein said selected bridges are located in respective axial registration with the leading edges of said partitions.

13. A nozzle box according to claim 11 wherein the number of bridges is greater than the number of partitions.

14. A nozzle box according to claim 11 wherein said selected bridges are located in respective axial registration with the leading edges of said partitions, remaining bridges of said plurality thereof being equally spaced between said selected partitions.

15. A nozzle box according to claim 11 including a torus segment for receiving steam from an inlet, said bridge ring segment being located relative to said torus segment and said nozzle ring segment for changing steam flow from a generally circumferentially direction about said torus segment to a generally axial flow direction for introduction into nozzles formed by said partitions.

* * * * *